United States Patent [19]

Walker

[11] Patent Number: 4,814,687

[45] Date of Patent: Mar. 21, 1989

[54] FOLLOWING VOLTAGE/CURRENT REGULATOR

[75] Inventor: Charles S. Walker, Seattle, Wash.

[73] Assignee: Honeywell, Inc., Minneapolis, Minn.

[21] Appl. No.: 146,546

[22] Filed: Jan. 21, 1988

[51] Int. Cl.[4] ..... G05F 1/565

[52] U.S. Cl. ..... 323/275; 323/281; 323/303; 323/907; 323/908

[58] Field of Search ..... 323/901, 907, 908, 274, 323/275, 276, 277, 281, 299, 303; 363/124

[56] References Cited

U.S. PATENT DOCUMENTS

| | | | |
|---|---|---|---|
| 3,916,294 | 10/1975 | Kennedy | 323/275 |
| 4,390,828 | 6/1983 | Converse et al. | 323/278 |
| 4,536,699 | 8/1985 | Baker | 323/281 |
| 4,580,090 | 4/1986 | Bailey et al. | 323/303 |
| 4,704,572 | 11/1987 | Melbert | 323/275 |
| 4,717,867 | 1/1988 | Forehand | 323/274 |

*Primary Examiner*—Peter S. Wong
*Attorney, Agent, or Firm*—C. Lamont Whitham; Michael E. Whitham

[57] ABSTRACT

A following voltage/current regulator includes a field effect transistor (FET) (48) connected in series between an unregulated voltage source (44) and a load, such as a motor bridge circuit (50). The conduction of the FET is controlled by a control circuit (56) which measures the input voltage to the FET source, the output voltage from the FET drain and the current drawn by the load. Initially, when power is turned on, the inrush current to the load is limited until a predetermined voltage differential between the input and output voltages is achieved at steady state. Then, the voltage regulator maintains the predetermined voltage differential to provide a well regulated output voltage to the load despite fluctuations in supply voltage. This "following" action limits the heat disipation and protects the FET. Because the voltage regulator uses no inductors or transformers, there are no saturation problems and the circuit may be compactly packaged. No switching spikes are produced to cause video interference, and due to suppression of ripple current by the voltage regulator, there is little conducted electromagnetic interference (EMI).

13 Claims, 6 Drawing Sheets

FOLLOWING VOLTAGE/CURRENT REGULATOR

STATEMENT OF GOVERNMENT INTEREST

The subject invention was developed under U.S. Army Contract No. DAAK20-84-C-0404, and the Federal Government has rights in the invention pursuant to the terms of said contract.

BACKGROUND OF THE INVENTION

1. Field of the Invention

The present invention generally relates to electrical voltage/current regulators and, more particularly, to a following voltage/current regulator for a motor drive circuit. In a specific application, the motor is used to rotate a scanning mirror in a Forward Looking Infrared (FLIR) system.

2. Background of the Invention

A FLIR scanning system employs an electrical motor to rotate, at a constant speed, a multifaceted mirror to horizontally scan a scene which is focused on one or more infrared (IR) detectors. The typical application for FLIR scanning systems is in aircraft and missiles for military applications. The motors used are generally three-phase, alternating current (AC) motors, and in a specific example, a 1/160 horse power (HP), three phase induction motor is used to drive the horizontal scanning mirror at 60,000 RPM. This motor operates in a vacuum, and the motor current increases as the vacuum level decreases. A one to four minute motor run-up time is required to attain full speed, and during this time there are large inrush currents.

A nominal +28V voltage source conforming to MIL-STD-704C (military standard) is specified for certain applications, including FLIR applications. Wide voltage excursions, a large steady-state voltage range, AC ripple and transient spikes characterize this type of power. Ideally, the scan motor would be driven from a constant +28V source free from all perturbations mentioned above. Additionally, MIL-STD-461A, Notice 4, places very tight limits on conducted emissions in the form of ripple current occuring in the +28V d.c. power line caused by the load, in this case, the motor bridge and the motor.

A power inverter bridge is required to convert the nominal +28V output to the required three phase, AC voltage necessary to drive the motor. Unfortunately, since the MIL-STD-704C voltage source produces fairly large fluxuations in steady state voltages and very large fluxuations in transient voltages, damage to the bridge and the motor can result. For example, this voltage source may have a steady state output which varies in the range of from about 20 to 29 volts, and 87V transients may exist. It is possible to operate the three phase motor, and its three phase inverter bridge, with steady state input voltages from 20 to about 29 volts. For transients over +34 volts, damage to the bridge will result.

Accordingly, it is desired to provide a circuit which will limit the voltage to the motor drive circuit to +29V for steady-state input voltages in excess of this value and to 34 volts for transients Adding to the critical design requirements of the voltage/current regulator is the fact that the FLIR video system is sensitive to electronic switching noise, only a limited volume is available for packaging and a low power dissipation is required.

It is possible to provide an all passive system to supply the necessary voltage to the inverter bridge circuit.

However, such a system would require a large L-C filter to meet the ripple requirements, a power Zener diode to protect the motor hybrid for transient voltages over +34V, and a change in specifications to allow 4.6A inrush current. For various reasons, these requirements cannot be met. Alternatively, a switching-type buck or buck-boost regulator with current limiting could be used. However, once again an L-C filter would be required to meet the ripple requirements, the regulator must be synchronized with the horizontal video raster scan of the FLIR system, and shielding would have to be added to prevent video interference.

SUMMARY OF THE INVENTION

It is therefore an object of the present invention to provide a voltage/current regulator for a motor drive circuit that is capable of providing a regulated voltage/current output from a voltage source which is subject of wide steady state and transient fluxuations.

It is a further object of the invention to provide a voltage/current regulator circuit which is capable of controlling the motor starting current, when power is initially applied, to a predetermined value and, when a steady state condition is achieved, to provide a regulated voltage output.

It is an additional object of the invention to have the motor starting current increase as the temperature decreases and decrease as the temperature increases.

It is yet another object of the invention to provide these features with a minimum of heat dissipation.

Another object of this invention is to prevent the large ripple current caused by the motor and motor bridge from being conducted in the +28V d.c. power line.

A further object of this invention is to prevent high input voltage transients from appearing on the motor bridge.

Another object of this invention is to reduce the magnitude of source voltage ripple voltage from appearing at the output.

And yet another object of the invention is to accomplish these requirements without transformers or inductors so as to minimize weight and volume.

It is still another, more specific object of the subject invention to provide a voltage/current regulator for a FLIR scanning motor which produces no voltage and/or current spikes to cause video interference.

According to the invention, a following voltage/current regulator is provided which includes a field effect transistor (FET) connected in series between an unregulated voltage source and a load, such as a motor drive circuit. The conduction of the FET is controlled by a control circuit which measures the +28V input voltage, the output voltage to the motor bridge and the current drawn by the load. Initially, when power is turned on, the motor starting or inrush current to the load is limited until a predetermined voltage differential between the input and output voltages is achieved at steady state. The voltage regulator then maintains this predetermined voltage differential for low power dissipation while providing a well regulated output voltage to the load despite large positive transients and fluctuations in supply voltage. The term "following voltage regulator" is descriptive of the operation of the regulator in maintaining this predetermined voltage differential.

Because the voltage/current regulator uses no inductors or transformers, there are no saturation problems and the circuit may be compactly packaged. No switching spikes are produced to cause video interference. Furthermore, suppression of the load ripple current means there is little conducted electromagnetic interference (EMI).

BRIEF DESCRIPTION OF THE DRAWINGS

The foregoing and other objects, aspects and advantages of the invention will be better understood from the following detailed description of the preferred embodiment of the invention with reference to the drawings, in which.

DETAILED DESCRIPTION OF A PREFERRED EMBODIMENT OF THE INVENTION

Figure 1:
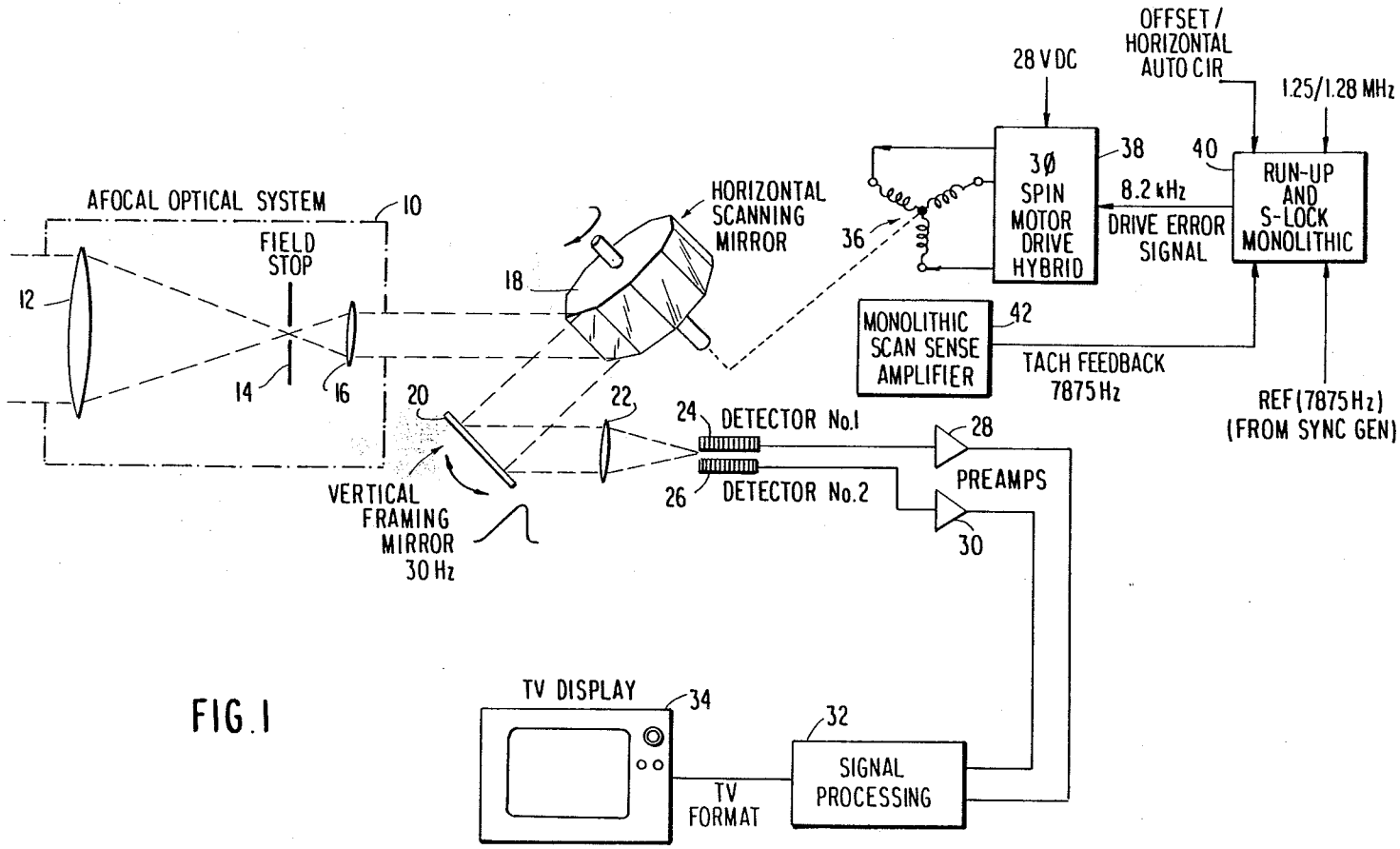
FIG. 1 is a block and schematic diagram illustrating the principal components of a FLIR system.

Referring now to the drawings, and more particularly to FIG. 1, there is shown an example of the principal components of a FLIR system, which is the environment for which the subject invention was designed. In FIG. 1, the FLIR system receiver includes an afocal optical system 10 including an objective lens 12, a field stop 14, and a colimnating lens 16. The colimnating lens 16 produces a colimnated beam of light which is directed toward a rotating, multi-faceted horizontal scanning mirror 18. The axis of rotation of mirror 18 is at an angle to the optical axis of the afocal optical system 10 to reflect the light from the colimnating lens 16 onto vertical framing mirror 20 and thence to condensing lens 22. Vertical framing mirror 20 is rotatable about an axis perpendicular to the axis of rotation of mirror 18 to allow for adjustment in the vertical direction of the image. Lens 22 focusses the scanned image onto a pair of IR detectors 24 and 26, the outputs of which are amplified by preamplifiers 28 and 30, respectively. The amplified signals from preamplifiers 28 and 30 are supplied to video signal processing circuitry 32 which generates an output in a television format, i.e., raster scanned, suitable for display on a cathode ray tube (CRT) display 34.

The details of the FLIR system as thus far described may be considered conventional and form no part of the subject invention except to impose certain design constraints already noted in the background of the invention. Specifically, the video signal processing circuitry 32 is highly susceptible to electronic switching noise. The invention is particularly directed to the power supply for the spin motor 36 which drives the horizontal scanning mirror 18. The motor 36 is energized from a motor drive circuit 38 which is part of a velocity servo circuit used to control the speed of the motor. More specifically, the drive circuit 38 receives a drive error signal from the run-up and speed lock circuit which compares a reference signal with a tachometer feedback signal from the scan sense amplifier 42. The scan sense amplifier 42 receives as its input the output of a phototransistor (not shown) which receives light from a light emitting diode (also not shown) reflected from the horizontal scanning mirror 18. Thus, the scan sense amplifier 42 receives a series of light pulses the frequency of which is proportional to the speed of rotation of the mirror 18 and generates an output signal which is the tachometer feedback signal. The invention is specifically concerned with the motor drive circuit 38 and, in particular, to a voltage regulator for the drive circuit which receives an unregulated +28VDC and generates a well regulated output to a drive circuit that produces a three phase AC output to drive motor 36.

Figure 2:
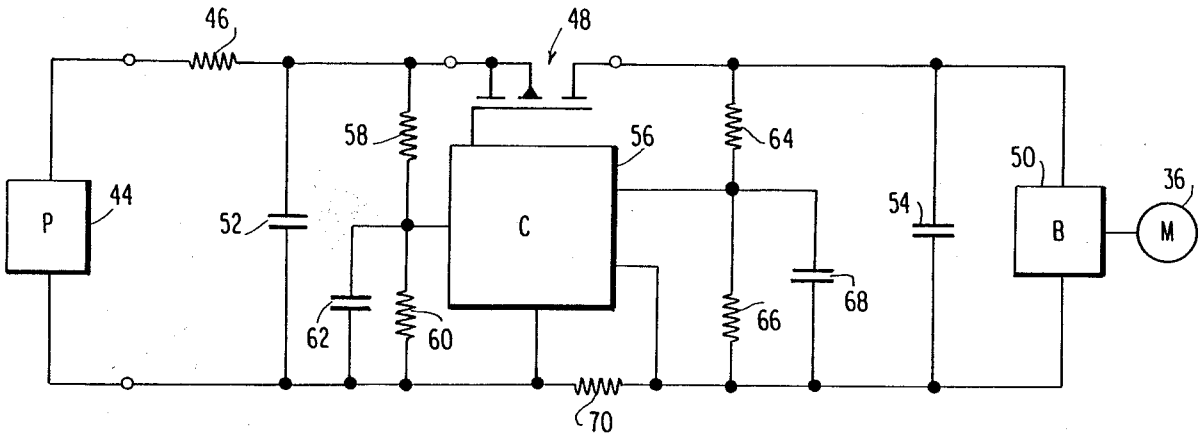
FIG. 2 is a block and schematic diagram showing the general features of the voltage regulator according to the invention.

FIG. 2 shows in generalized form the voltage regulator according to the invention. A +28VDC power source 44 is connected in series with the resistance of the d.c. line 46, a P-channel, metal oxide semiconductor field effect transistor (MOSFET) 48 to a three phase bridge 50 that supplies the AC drive current to motor 36. In a preferred embodiment of the invention, the MOSFET 48 is an RCA RFM12P10 device. A first capacitor 52 is connected across the power source 44 and, with DC line resistance 46, provides some degree of steady-state and transient filtering for the output voltage from the power source 44. A second capacitor 54 is connected across bridge circuit 50 to provide a by-pass for the motor bridge ripple current and to act a smoothing filter for the output voltage from FET 48.

This is a series regulator and the magnitude of the voltage supplied to the three phase bridge 50 is a function of the conduction of FET 48. This in turn is controlled by control circuit 56 connected to the gate of FET 48. This circuit, which is described in more detail hereinafter, has measuring inputs connected on either side of the FET 48. More particularly, a voltage divider comprising resistors 58 and 60 is connected across capacitor 52 and provides an input to the control circuit 56 which is proportional to the net input voltage to the voltage/current regulator. A capacitor 62 is connected in parallel with resistor 60 and, with resistors 58 and 60, provides a time constant on voltage transients or fluxations from the power source 44. A second voltage divider comprising a pair of series connected resistors 64 and 66 is connected across the output, the motor bridge. A capacitor 68 is connected in parallel with resistor 66 and acts as a high frequency shunt to effectively disable the loop formed by the control circuit 56, FET 48 and resistor 64, thereby greatly reducing the motor ripple current in the voltage supply lines. The second voltage divider functions as a measuring circuit to provide an output proportional to the output voltage from FET 48. Thus, the control circuit 56 measures the input from power source 44 via the first voltage divider comprising resistors 58 and 60 and the output from FET 48 via second voltage divider comprising the resistors 64 and 66. In addition, control circuit 56 measures the current drawn by bridge 50 and motor 36 via the current measuring resistor 70.

Figure 3:
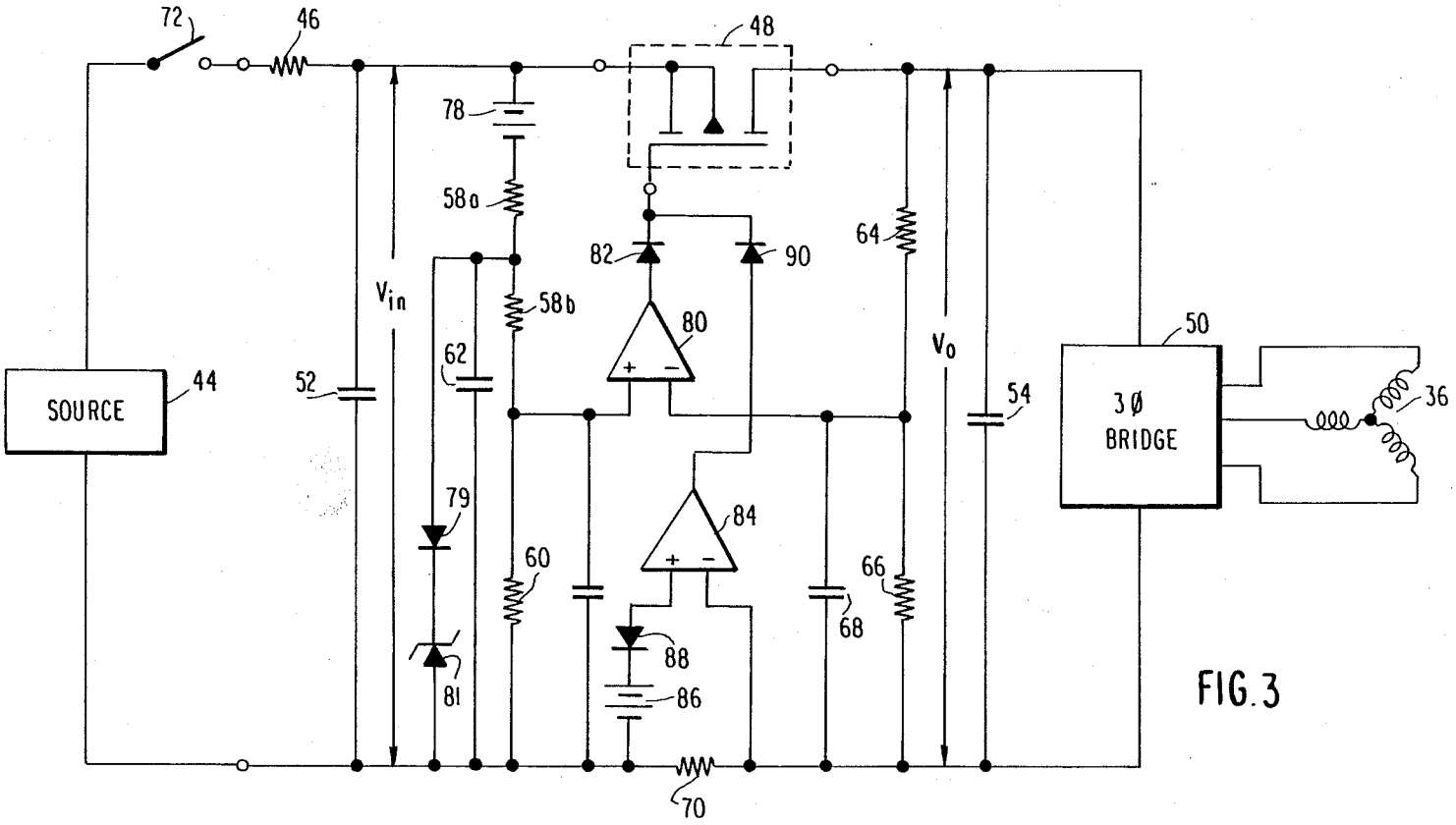
FIG. 3 is a conceptual schematic diagram showing in more detail the circuit of the voltage regulator according to the invention.

The theory of operation of the voltage regulator according to the invention will be better appreciated by reference to FIG. 3 wherein like reference numerals designate the same of functionally similar parts. In addition to the line resistance 46, there is shown a power supply switch 72 which may be opened to disconnect the power source 44 from the rest of the circuitry shown. The voltage divider comprising resistors 58 and 60 is modified by dividing resistor 58 into two resistors 58*a* and 58*b* and inserting, hypothetically, a battery 78 in series with the voltage divider. As will be explained in more detail hereinafter, the battery 78 is actually a portion of a constant voltage derived from a Zener diode. Further, the junction of resistors 58*a* and 58*b* is connected via a junction diode 79 to Zener diode 81 and then to the return of the power source 44. The back-biased Zener diode 81 provides a voltage reference to amplifier 80 and is effective to limit the output voltage to a maximum value for all input voltages over a predetermined value.

The control circuit 56 comprises, symbolically, a first differential amplifier 80 having as one input the voltage across resistor 60 and as the other input the voltage across resistor 66. The output of differential amplifier 80 is connected, again symbolically, via diode 82 to the gate of FET 48. The control circuit further comprises, also symbolically, a second differential amplifier 84 having as one input a reference voltage provided by a hypothetical battery 86 and an ideal blocking diode 88 and as the other input the junction between current measuring resistor 70 and bridge 50. The output of differential amplifier 84 is connected, again symbolically, via diode 90 to the gate of FET 48. The diodes 82 and 90 form an isolation circuit so that either of the outputs of the differential amplifiers 80 and 84 control the conduction of FET 48.

When switch 72 is closed, +22 to +29VDC is applied across the circuit. Differential amplifier 84 senses the current drawn by motor 36 and limits the inrush current to approximately 1.8 amperes. As the temperature decreases, this current limit is automatically increased (to 2.2 amperes at −40° C.) due to the negative temperature coefficient of voltage source 86. This effect is desirable and necessary because, due to increased bearing friction and gas viscosity, the motor 36 will not start without a current limit increase. Correspondingly, as the temperature increases, the bearing firction and gas viscosity both decrease, as does the current limit value. This provides an added benefit in that the series transistor 48 suffers less heat transient stress which is a requirement as the temperature increases.

When $V_{in}-V_o=1.8$ volts, current limiting action ceases and the input voltages to differential amplifier 80 from the two voltage dividers take over to maintain the 1.8V differential. This 1.8V differential is provided by battery 78. Since this differential is constant over the input voltage range of +22 to 29V, power dissipation in MOSFET 48 is also approximately constant over the input voltage range. This is in dramatic constrast to the standard series regulator which produces power losses directly proportional to the difference between the input and output. For example, when $V_{in}=+22V$, $V_{out}=22-1.8=+20.2V$, and there would be 1.8 units of power loss in the MOSFET 48. With $V_{in}=+29V$, $V_{out}$ is still 20.2V and the losses are now $29-20.2=8.8$ units. This invention maintains the losses at 1.8 units, thus the term "following regulator".

In addition to minimizing power dissipation, the invention also reduces ripple current fifty times by the high drain-to-source impedance of FET 48 and the loop disabling capacitor 68. Further, the output voltage $V_o$ is held to +30V maximum by the reference voltage supplied by Zener diode 81, and the input ripple voltage is absorbed by FET 48 preventing motor jitter.

Figure 4:
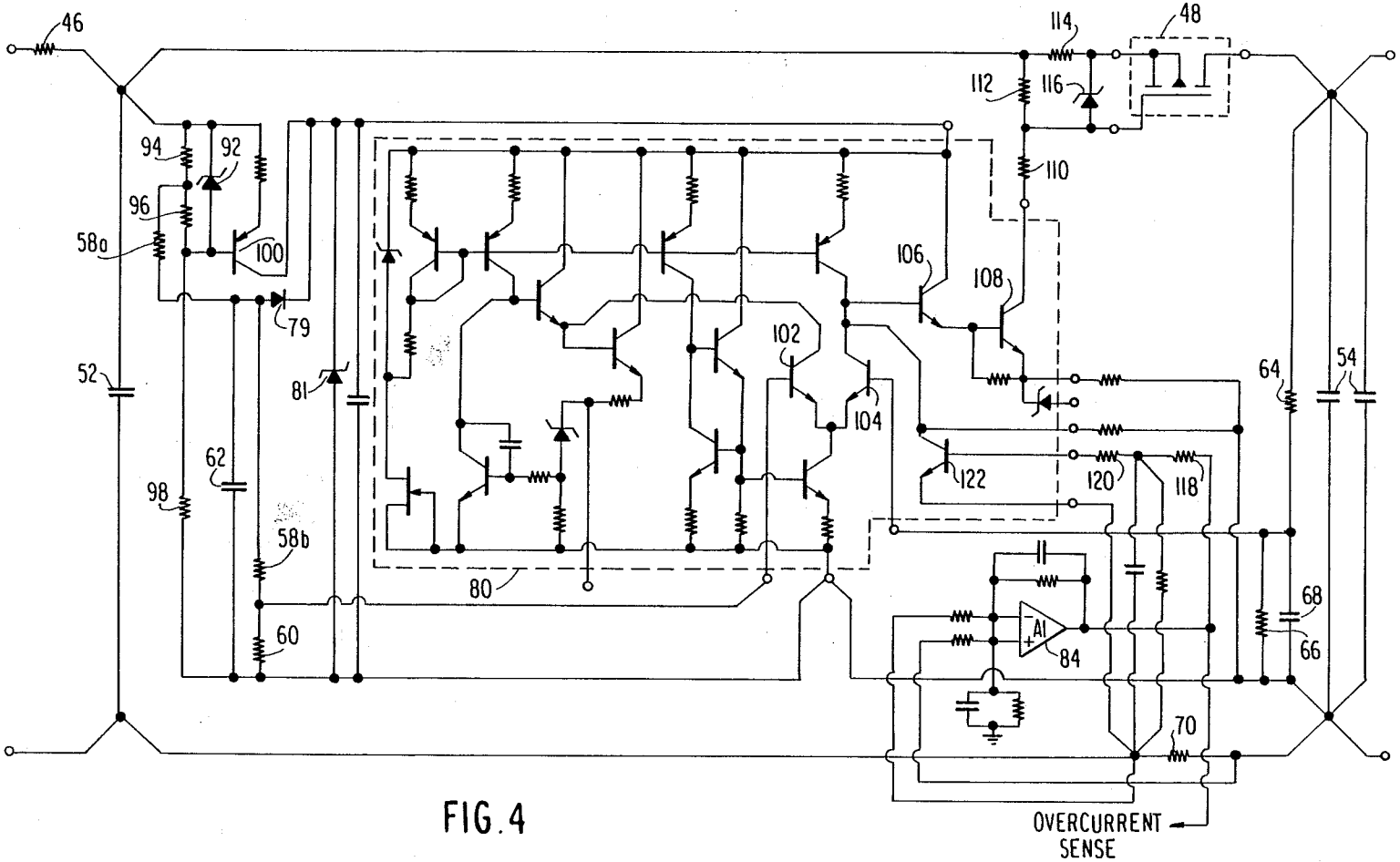
FIG. 4 is a detailed schematic diagram showing the best mode for implementing the voltage regulator according to the invention.

FIG. 4 shows the detailed schematic diagram of the voltage regulator circuit as implemented. Again, like reference numerals refer to the same or functionally similar components. Here, it will be observed that the battery 78 is replaced by a constant voltage source comprising a back-biased Zener diode 92 connected in parallel with series connected resistors 94 and 96 and in series with resistor 98. The resistors 94, 96 and 98 form a voltage divider having two junctions. The first junction between resistors 94 and 96 is connected to resistor 58*a*. The second junction between resistors 96 and 98 is connected to the base of a PNP transistor 100 connected as a series regulator current source to supply, via diode 79 and Zener diode 81, a constant +10 volts for circuit 80. The Zener diode 92 and resistors 94 and 96 establish the 1.8VDC reference. Junction diode 79 and Zener diode 81 serve the purpose of limiting the output to about +30V for inputs exceeding about +31.8V.

The circuit 80, although shown in detail, is a commercially available circuit and is therefore not described in detail. More specifically, the circuit 80 may be μA723 precision voltage regulator manufactured by Fairchild or a Motorola MC1723 monolithic voltage regulator. The purpose of showing the detail of the circuit 80 is to show the manner in which the input and output circuits are connected. Thus, the two inputs to the circuit are supplied to the bases of differential transistor pair 102, 104. The output of circuit 80 is taken from the collector of transistor 104 and supplied to the base of emitter follower transistor 106 which drives the base of transistor 108. The collector of transistor 108 is connected to the gate of FET 48 via resistor 110.

The network comprising resistors 112 and 114 connected across the source and gate of FET 48 constitute a feedback circuit which tends to linearize the FET 48 and decreases the source-drain conductance. Zener diode 116 prevents the FET 48 gate-to-source voltage from exceeding the maximum voltage rating.

The output of differential amplifier 84, which may also be a commercially available amplifier, is connected via resistors 118 and 120 to the base of transistor 122 within circuit 80. The collector of transistor 122 is connected to the collector of transistor 104.

With reference to FIG. 3, the transistors 122 and 104 perform the function of diodes 82 and 90. Transistor 122 also performs the function of voltage source 86 and diode 88. More specifically, transistor 122 has a negative threshold voltage-with-temperature coefficient to provide the current limit increase at start up as the temperature decreases and, correlatively, a decrease in current limit with increasing temperature. The emitter-base junction also performs the function of blocking diode 88.

Figure 5:
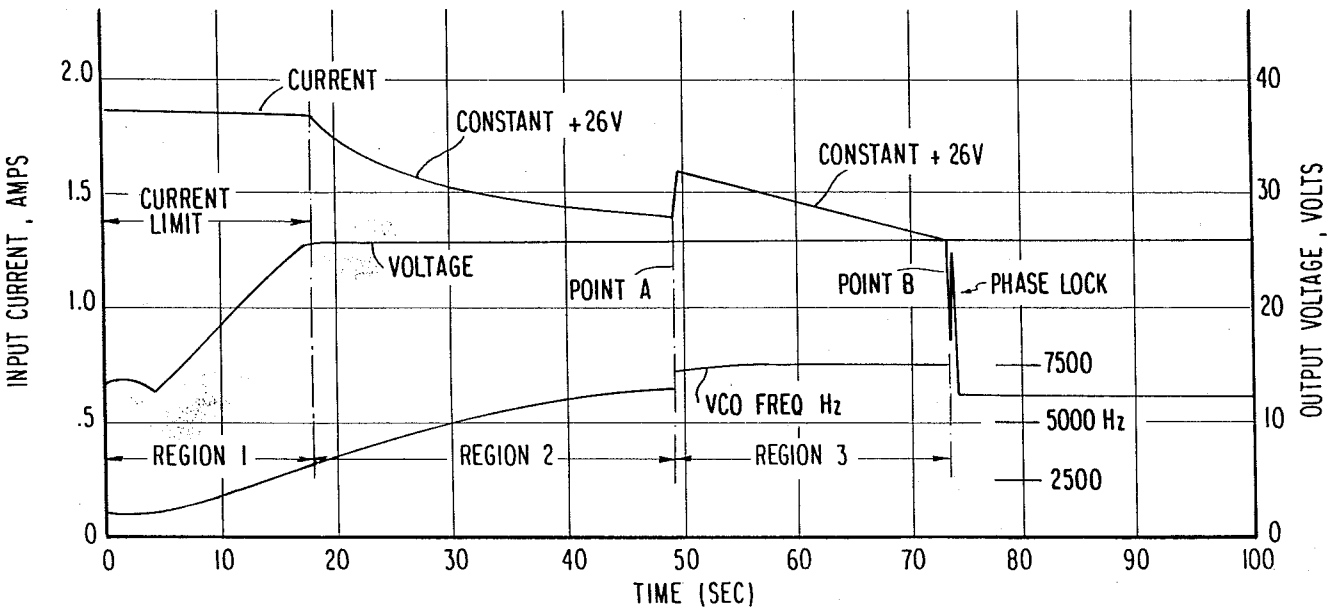
FIG. 5 is a graph showing test data for the motor run-up current using the voltage regulator of the invention.
Figure 6:
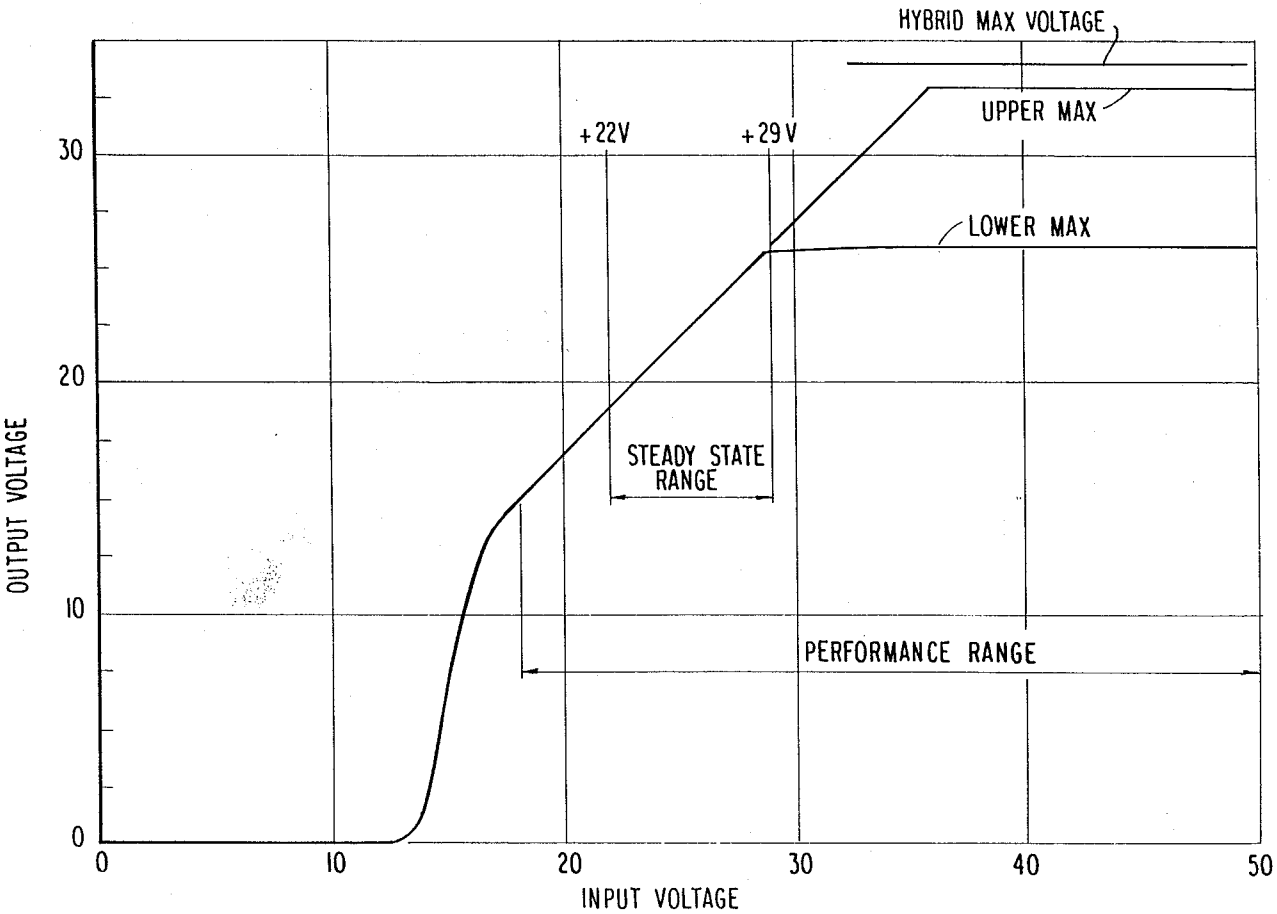
FIG. 6 is a graph showing test data for voltage following scan motor regulator plotted as output voltage vs. input voltage.

The circuit shown in detail in FIG. 4 was used to develop test data which is illustrated in FIGS. 5 and 6. FIG. 5 shows the current and voltage data plotted as a function of time illustrating the motor run-up characteristics. In region 1, the current is controlled while the bridge voltage ranges between +13 and 26V. In region 2, the regulator furnishes a constant voltage. At point A, the VCO frequency increases from 6.5 kHz to 7.54 kHz. This increase brings greater slip, more motor torque and additional bridge current. In region 3, the motor continues to accelerate until the motor feedback frequency equals the reference frequency 7.875 kHz. This occurs at point B, indicating phaselock. The VCO frequency drops to approximately 6.2 kHz. Since the motor is at steady state speed and not accelerating, the current drops from 1.6A to 0.62A. This data demonstrates the excellent regulation provided by the circuit with motor current changes.

FIG. 6 shows the output voltage plotted as a function of input voltage illustrating the voltage following characteristics of the circuit. For input voltages less than +12.5 volts, the output is approximately zero. For input voltages between +18 and 29V, the output is three volts less. It should be noted that an additional 1.2 volts was added to the actual data to allow for input line resistance drop. The actual differential voltage was set at 1.8 volts. For inputs above +29V, the output, on a steady state basis, is +26V.

The circuit limits the output voltage to 30VDC maximum for input voltages over +31.8V. In summary, it has been shown by diagrams and test data that the various objects of the invention have been achieved. These include a motor drive voltage/current regulator operation over a wide input voltage range. The motor starting current is limited to 1.8 amperes, and this is automatically increased (to 2.2 amperes at −40° C.) by the negative temperature coefficient of voltage source 86 (provided by transistor 122). Minimum heat dissipation is achieved through a constant input/output voltage differential at steady state. The MIL-STD-461A conducted emissions (ripple current) requirement is achieved by means of bypass capacitor 60 and source-to-drain impedance enhancement feedback circuit consisting of resistors 112 and 114. High transient voltages are prevented from appearing on the motor bridge by way of diode 79 and Zener diode 81. The output voltage ripple is reduced due to input voltage ripple by capacitor 62 and resistors 58*a*, 58*b* and 60. No transformers or inductors are required. Ripple current reduction is accomplished by semiconductors and feedback instead of bulky inductors and capacitors. And because the circuit has no inductors or transformers, there can be no saturation problems and a compact, easily hybridized design is possible. Finally, in this circuit there are no switching spikes to cause video interference. This is made possible by the continuous, linear closed-loop feedback design.

While the invention has been described in terms of a single preferred embodiment, those skilled in the art will recognize that the invention may be practiced within the spirit and scope of the appended claims.

Having thus described my invention, what I claim as new and desire to secure by Letters Patent is as follows:

1. A voltage/current regulator for supplying regulated voltage from an unregulated source to a bridge and motor load and limiting an inrush current to the load comprising:

a transistor connected in series with said load, said transistor including first and second current conducting electrodes and a control electrode; and control circuit means connected to said control electrode for controlling the conduction of said current conducting electrodes, said control circuit means including current limit feedback means for limiting the current drawn by said load, said control circuit means including bypass means to prevent said transistor from supplying bridge ripple current to said unregulated source.

2. The voltage/current regulator recited in claim 1 further comprising a capacitor connected across said bridge and motor load to absorb load ripple current.

3. A following voltage/current regulator for supplying regulated voltage from an unregulated source to a load and limiting an inrush current to the load comprising:

a metal oxide semiconductor field effect transistor connected in series with said load, said field effect transistor including source, drain and gate electrodes; and control circuit means connected to said gate electrode for controlling the conduction of said field effect transistor, said control circuit means including first means for measuring the input voltage at said source electrode, second means for measuring the output voltage at said drain electrode, and third means for measuring the current drawn by said load, said control circuit means limiting inrush current to said load to a predetermined level until a predetermined voltage differential is achieved between said input and output voltages and thereafter automatically maintaining said predetermined voltage differential to provide for minimum losses in the field effect transistor.

4. The following voltage/current regulator recited in claim 3 wherein said control circuit means further comprises temperature compensation means increasing said inrush current when the ambient temperature decreases and decreasing the inrush current as the ambient temperature increases.

5. The following voltage/current regulator recited in claim 3 wherein said first means includes constant voltage means having a voltage equal to said predetermined voltage differential.

6. The following voltage/current regulator recited in claim 3 wherein said first means comprises a voltage divider comprising first and second resistors connected in series with a constant voltage means having a voltage equal to said predetermined voltage differential, said second means comprises a voltage divider comprising third and fourth resistors, and further comprising differential means having a first input connected to a junction of said first and second resistors and a second input connected to a junction of said third and fourth resistors, said differential means having an output connected to the gate electrode of said field effect transistor.

7. The following voltage/current regulator recited in claim 6 wherein said third means comprises:

a current measuring resistor connected in series with said load;

second differential means having first and second inputs and an output, said first input being connected to a junction of said current measuring resistor and said load, said output being connected to the gate electrode of said field effect transistor; and second constant voltage means connected to the second input of said second differential means, said second constant voltage means varying as temperature changes to increase the inrush current to said load as the temperature decreases and decrease the inrush current to said load as the temperature increases.

8. The following voltage/current regulator recited in claim 6 further comprising a first capacitor connected in parallel with said second resistor and a second capacitor connected in parallel with said fourth resistor, said first capacitor in combination with said first and second resistors providing time constant on voltage transients and fluxuations from said unregulated source, said second capacitor acting as a high frequency shunt to effectively disable the loop formed by the control circuit means, the field effect transistor and the third resistor.

9. The following voltage/current regulator recited in claim 6 wherein said first resistor is comprised of fifth and sixth resistors connected in series and further comprising voltage reference means connected to a junction of said fifth and sixth resistors for providing a voltage reference to said first differential means to limit the output voltage of said regulator to a maximum value for all input voltages over a predetermined value.

10. The following voltage/current regulator recited in claim 6 further comprising a bypass capacitor connected in parallel with said fourth resistor and source-to-drain impedance enhancement feedback means connected to said field effect transistor.

11. The following voltage/current regulator recited in claim 10 wherein said source-to-drain impedance enhancement feedback means comprises resistance means connected between said source and gate electrodes of said field effect transistor.

12. The following voltage/current regulator recited in claim 6 wherein said first resistor is comprised of fifth and sixth resistors connected in series and further comprising a capacitor connected to a junction of said fifth and sixth resistors for reducing output voltage ripple.

13. The voltage/current regulator recited in claim 1 wherein said current limit feedback means comprises temperature compensation means increasing the current drawn by said load when the ambient temperature decreases and decreasing the current as the ambient temperature increases.

* * * * *